US009609897B2

(12) United States Patent
Siddall-Cohen

(10) Patent No.: US 9,609,897 B2
(45) Date of Patent: Apr. 4, 2017

(54) BRA CUP SUPPORT MEMBER

(71) Applicant: Curvessence Pty Ltd., Cremorne (AU)

(72) Inventor: Kathleen Siddall-Cohen, Cremorne (AU)

(73) Assignee: Curvessence Pty Ltd., Cremorne (AU)

( * ) Notice: Subject to any disclaimer, the term of this patent is extended or adjusted under 35 U.S.C. 154(b) by 245 days.

(21) Appl. No.: 14/352,753

(22) PCT Filed: Oct. 17, 2012

(86) PCT No.: PCT/AU2012/001258

§ 371 (c)(1),
(2) Date: Apr. 18, 2014

(87) PCT Pub. No.: WO2013/056302

PCT Pub. Date: Apr. 25, 2013

(65) Prior Publication Data

US 2014/0302747 A1 Oct. 9, 2014

(30) Foreign Application Priority Data

Oct. 18, 2011 (AU) ..... 2011904287

(51) Int. Cl.
*A41C 3/12* (2006.01)
*A41C 5/00* (2006.01)

(52) U.S. Cl.
CPC ..... *A41C 3/122* (2013.01); *A41C 5/00* (2013.01)

(58) Field of Classification Search
CPC ..... A41C 3/0007; A41C 3/142; A41C 3/122; A41C 3/126; A41C 5/005
USPC ..... 450/41, 42, 47, 51, 52; 2/267, 255
See application file for complete search history.

(56) References Cited

U.S. PATENT DOCUMENTS 3,777,763 A * 12/1973 Schwartz ..... A41C 3/126 2/257
4,235,240 A 11/1980 Cousins
5,167,891 A * 12/1992 Dijkman, Sr. ..... A41C 3/122 264/145
6,439,960 B1 8/2002 Fildan et al.
(Continued)

FOREIGN PATENT DOCUMENTS

CN 2430859 Y 5/2001
CN 2673138 Y 1/2005
(Continued)

OTHER PUBLICATIONS

Extended European Search Report for European patent application No. 12841722.7 dated Sep. 2, 2015 (6 pages).
(Continued)

*Primary Examiner* — Gloria Hale
(74) *Attorney, Agent, or Firm* — Wolf, Greenfield & Sacks, P.C.

(57) ABSTRACT

A support member for a lower edge region of a bra cup is disclosed that has an elongate portion that is curved. The curvature varies in three dimensions as it extends between medial and lateral ends of the support member, and the curvature may reduce towards the lateral end. A bra cup comprising the support member is also disclosed that has a lower edge that follows the curvature of the support member. The bra cup can be formed by embedding the support member between two padded portions and fusing the support member in place.

25 Claims, 8 Drawing Sheets

(56) References Cited

U.S. PATENT DOCUMENTS

| | | | | |
|---|---|---|---|---|
| 6,447,365 | B1 | 9/2002 | Powell et al. | |
| 6,695,677 | B1 | 2/2004 | Lin | |
| 6,811,464 | B2 * | 11/2004 | Li | A41C 5/005 450/39 |
| 7,425,170 | B1 * | 9/2008 | Herbert | A41C 3/122 2/255 |
| 7,429,205 | B1 * | 9/2008 | Huang | A41C 3/142 2/267 |
| 7,604,526 | B2 * | 10/2009 | Liu | A41C 3/0007 450/39 |
| 2002/0177385 | A1 * | 11/2002 | Brothers | A41C 3/0064 450/41 |
| 2007/0293127 | A1 | 12/2007 | Yu et al. | |
| 2009/0017724 | A1 | 1/2009 | Gill | |
| 2011/0117817 | A1 * | 5/2011 | Cheng | A41C 3/122 450/41 |
| 2012/0178341 | A1 * | 7/2012 | Cheung | A41C 3/122 450/41 |
| 2014/0227943 | A1 * | 8/2014 | McNeeley | A41C 3/0007 450/41 |
| 2014/0302747 | A1 * | 10/2014 | Siddall-Cohen | A41C 5/00 450/41 |

FOREIGN PATENT DOCUMENTS

| | | | |
|---|---|---|---|
| CN | 1931471 | A | 3/2007 |
| CN | 101112256 | A | 1/2008 |
| DE | 202 06 037 | U1 | 8/2003 |
| DE | 20 2007 002 194 | U1 | 8/2007 |
| WO | WO 2009/026752 | A1 | 3/2009 |

OTHER PUBLICATIONS

International Search Report and Written Opinion for PCT/AU2012/001258, mailed Dec. 4, 2012 (11 pages).

English translation of the First Office Action dated May 6, 2015 for Chinese application No. 2012800624127 (5 pages).

* cited by examiner

PRIOR ART

ISOMETRIC VIEW

SIDE VIEW

FRONT VIEW

BRA CUP SUPPORT MEMBER

RELATED APPLICATIONS

The present application is a national stage filing under 35 U.S.C. §371 of international PCT application, PCT/AU2012/001258, filed Oct. 17, 2012, which claims priority to Australian patent application, AU 2011904287, filed Oct. 18, 2011, each of which is incorporated herein by reference.

FIELD OF THE INVENTION

The present invention relates to a bra cup and components of a bra cup. In particular, the present invention relates to a bra cup including a support structure.

BACKGROUND OF THE INVENTION

Many women today wear a typical bra known as an underwire bra, to support and shape the bust. The bra includes two cups adapted to support the breasts. Commonly used methods to form each cup include combining fabric shapes together or moulding a cup shape at high temperature in pre set die cast shapes.

However, fabric shaping or moulding alone can be insufficient to hold the shape of the bra cup, thereby requiring additional controlling elements or support structures to be used, typically in the form of rigid or nearly rigid metal underwires that are inserted into a channel at the lower edge of each bra cup as indicated in FIG. 1. A typical underwire bra cup 1, as depicted in FIG. 1, is made from various layers of foam and fabric 11, which are held together before moulding with resins and glue. A fabric casing or tube 12 including a channel is sewn or glued to the lower edge 13 of a surface 14 of the cup 1 to house the underwire 15. The underwire 15 is inserted through one end of the channel.

The underwire prevents the cups from flattening out when the bra is stretched around the body. The underwire also assists in determining projection and volumetric distribution of the breast in the bra cup. The underwire can position the breast relative to the wearer's torso and contributes to the support and fit provided by the bra cup.

The underwire is generally configured in a flat U-shape and is commonly made from steel. The underwire may unintentionally be bent out of shape, however. This can occur during washing, especially in washing machines, in storage if the bra is poorly confined in a small space, and through wearing as the bra ages and metal fatigue sets in. Once a bra wire becomes bent out of shape or broken the bra is effectively unwearable.

A further disadvantage associated with underwire bras is that the underwire has a tendency to work its way out of the casing channel. This can happen during washing, especially in washing machines, and also during normal wearing over time. Once the underwire is lost from its casing channel the bra is effectively unwearable.

A further disadvantage associated with underwire bras is that, after prolonged wear, underwire can cause pressure and pain to the wearer, particularly at the ends of the underwire. For example, significant pain can be experienced by the wearer due to pressure exerted against the body by a lateral end of the underwire, the pain being associated with the wearer's upper rib cage area.

Research indicates that many women who wear bras do not like the idea of metal being used in an intimate product that sits in close contact with the body including the breasts. There are also opinions that the metal underwire is uncomfortable and unhealthy if worn in close proximity to the body. Women's breasts are the topic of many health debates and awareness of disease prevention has never been more apparent. While opinion is subjective, perception is a very strong indicator of women's preferences in, relation to a bra's fit, functionality, desirability and comfort.

The present disclosure may substantially overcome or at least ameliorate one or more of the above disadvantages, or provide a useful alternative.

Any discussion of documents, acts, materials, devices, articles or the like which has been included in the present specification is not to be taken as an admission that any or all of these matters form part of the prior art base or were common general knowledge in the field relevant to the present disclosure as it existed before the priority date of each claim of this application.

SUMMARY OF THE INVENTION

In a first aspect of the present disclosure, there is provided a support member for a lower edge region of a bra cup, the support member comprising a medial end and a lateral end and the support member having an elongate portion extending between the medial end and the lateral end, wherein the elongate portion is curved and the curvature of the elongate portion varies in three dimensions as it extends between the medial and lateral ends.

In another aspect, there is provided a bra cup comprising the support member according to the first aspect.

In some embodiments, the bra cup may include a channel adjacent a lower edge of the bra cup for receiving the support member. The channel may comprise a medial end and a lateral end and an elongate portion extending between the medial end and the lateral end, wherein the elongate portion of the channel is curved and the curvature of the elongate portion varies in three dimensions as it extends between the medial and lateral ends of the channel. The curvature of the channel may be similar or identical to the curvature of the support member. This may be such that the support member can be located in the channel without the channel being distorted. For simplicity, the curvature of the support member only is discussed in subsequent paragraphs; however, it should be understood that channel may have the same or similar curvature. The bra cup comprising the channel may be an unlined bra cup, such as a bra cup without padding such as foam padding. A cavity or pocket provided on fabric forming the bra cup may provide the channel into which the support member can be inserted. Nevertheless padded bra cups may also be provided having a channel.

In alternative embodiments, however, there may be no channel pre-formed in the bra cup for receiving the support member. For example, the support member may be embedded or fused into padding of a bra cup, such as to distort the padding about the support member. Frictional engagement due to distortion of the padding may serve to hold the support member in position. However, adhesive and/or other types of securing means may also be used.

The support member may be considered a rib for the bra cup. The support member may be used in place of traditional underwire. By pre-shaping the support member such that it is curved in three dimensions, the support member when located in the bra cup may conform more appropriately to the shape of a wearer's body from a medial region of the wearer's chest, where the medial end of the support member can be located, underneath the wearer's breast, to a lateral region of the wearer's chest where the lateral end of the support member can be located. The approach may provide for improved fit and comfort of the bra cup, with relatively little or no flexing of the support member required to align the lower edge of the bra cup with the contours of the body when the bra cup is worn.

By curving in three dimensions between the medial and lateral ends, the elongate portion may be considered to extend along a curved path that varies in direction between the medial and lateral ends in each of perpendicular x-, y- and z-axes, regardless of how the axes are oriented with respect to the support member. Considered another way, the curvature of the path is not in one plane only, unlike traditional U-shaped curvature of underwire of the prior art, for example. The elongate portion of the support member may be continuously curved along the entire length between the medial and lateral ends, or may be continuously curved along a major portion of the length only. The curve may vary continuously in each of the x-, y- and z-directions.

In one embodiment, the curvature may be described with respect to a body of the wearer by taking a line normal to the wearer's torso, and tracing a curve around the torso at the edge of the breast, generally at a region where the breast begins to protrude or change direction from the torso, while keeping the line tangential to the initial protrusion and generally normal to the torso. Curvature of the body may be determined from three-dimensional body scans in some embodiments.

The cross-sectional shape of the support member, in a direction perpendicular to the direction of elongation of the support member, may be a substantially rectangular shape or otherwise. The cross-sectional shape may have first and second surfaces that substantially oppose each other, and third and fourth surfaces that substantially oppose each other, wherein the third and fourth surfaces are substantially perpendicular to the first and second surfaces. The first and second surfaces may each have a width that is greater than a width of each of the third and fourth surfaces. The first and second surfaces may be configured to lie substantially parallel to the contours of the surface of a wearer's body, in particular the torso of the body, e.g. directly underneath and to the side of the breast, when worn. To avoid discomfort when worn, corners between the first and second surfaces and the third and fourth surfaces may be rounded. The third and fourth surfaces may be partially or completely curved across their widths. The curvature of the support member may be defined e.g. with respect to the first surface, which may lie closest to the torso.

The curved path followed by the support member between its medial and lateral ends may reduce in curvature toward the lateral end of the support member. In accordance with this, in one aspect, there is provided a support member for a lower edge region of a bra cup, the support member comprising a medial end for location at or adjacent a sternum of a wearer of the bra cup and a lateral end for location at or adjacent a lateral side of the wearer, the support member having an elongate portion extending between the medial end and the lateral end, wherein the elongate portion is curved and the curvature of the elongate portion varies in three dimensions as it extends between the medial and lateral ends, and wherein the degree of curvature of the elongate portion reduces from a medial region of the elongate portion to a lateral region of the elongate portion.

By reducing in curvature, it has been found that the lateral region of the support member may extend nearer to the armpit of the wearer, along a portion of the wearer's torso that provides improved support for the bra cup and increased comfort for the wearer. At this lateral region of the torso, the protrusion of the breast is relatively less well defined relative to the torso, and therefore providing optimum positioning of the lateral end is particularly important. In some embodiments, the lateral end of the support member may locate higher up the body (i.e. superiorly) when worn than the medial end of the support member.

In any of the aspects, the elongate portion can have a transition region intermediate the medial and lateral ends, wherein the curvature of the elongate portion is greater on a medial side of the transition region than on a lateral side of the transition region. Preferably, the transition region includes no sharp bend or angle, such that the elongate portion remains continuously and smoothly varying in curvature across the transition region. In accordance with this, the curvature of the entire elongate portion may be a spline, with smooth polynomial function that is piecewise-defined while maintaining a high degree of smoothness at the positions where the polynomial pieces connect. However, the degree of curvature may be seen to be relatively different, at least on average, for the section of spline on one side of the transition region in comparison to the section of the spline on the other side of the transition region.

The transition region may be closer to the lateral end than the medial end. For example, the transition region may be between about 20% and 50%, or between about 25% and 40%, or e.g. about one third along the length of the support member from the lateral end. On the medial side of the transition region, the support member may therefore follow a path having an average radius of curvature that is smaller than the average radius of curvature of the path followed by the support member on the lateral side of the transition region. The support member may twist at the transition region (rotate about its axis of elongation at the transition region). The twist at or adjacent the transition region, about the axis of elongation at the transition region, may be between about 5 and 30° or between about 10° and 20° or otherwise.

The arrangement may be such that, between the medial end and the transition region, the curved path substantially follows the surface of a notional sphere. The first surface of the support member may lie substantially flat against the surface of the notional sphere at this region. However, the arrangement may be such that, between the transition region and the lateral end, the curved path diverges radially outwardly from the surface of the notional sphere. The divergence from the surface may be at an angle of between e.g. 10° and 45°, or 20° and 40°, e.g. about 30°. When a bra cup bearing the support member is worn, the transition region of the support member may be located, for example, at a position where the front of the chest substantially transitions into a lateral side of the chest, around the rib cage.

Due to its 3-dimensionally curved shape, the support member may deviate substantially from a notional best fit plane extending through the curved path followed by support member. The arrangement may be such that the support member may extend on one or both sides of the best fit plane by greater than 5 mm, greater than 7 mm or greater than 10 mm, for example.

The support member may comprise a polymeric compound or otherwise. The support member may have a stiffness that is greater than material forming the bra cup. The bra cup may comprise padding, e.g. polyurethane foam. The bra cup may be formed in at least two parts, e.g. from a first portion and a second portion that are brought together around the support member. The first portion can have a concave surface and the second portion can have a concave surface and the concave and convex sides can be at least partially located in abutment and secured together, e.g. by bonding or gluing and/or using heat treatment and/or pressure treatment, with the support member located between the first and second portions at a lower edge region of the cup. The support member may be bonded to one or both of the first and second portions. The forming process may effectively fuse the first and second portions and the support member together, e.g. such that the first and second portions and the support member are not readily separable, e.g. without causing significant damage to the bra cup.

Although the support member may be located between two portions as indicated above, in alternative embodiments, a channel may be pre-formed in the bra cup, e.g. of fabric material stitched to an outer surface of the bra cup, and the support member may be extended into the channel from an opening at one end of the channel.

The channel and/or the lower edge of the bra cup may be configured to follow the curvature of the support member. The lower edge may be pre-configured to follow the curvature of the support member prior to location of the support member in position in or on the bra cup.

In one aspect, the present disclosure provides a bra cup comprising:

a first portion made of polyurethane foam and having a concave side;

a second portion made of polyurethane foam and having a convex side, the concave side and convex side being located in abutment and secured together;

a 3-dimensionally curved elongate support member made of a polymeric compound located between and bonded to the concave side and the convex side;

wherein lower edges of the concave side and convex side follow the curvature of the elongate support member;

further wherein the polymeric compound has a stiffness which is greater than a stiffness of the polyurethane foam.

The elongate support member may be considered to provide a rib for the bra cup. In any of the aspects described herein, the support member may be manufactured by a plastics injection or compression moulding process. A different mould may be used for support members to be located in left and right bra cups, and for support members to be used in different sizes of bra cups.

The support member may comprise polymeric compound that includes one or more of the following: polycarbonate, polyether ether ketone (PEEK), polysulphone, polyamide, e.g. super tough polyamide, nylon and dough moulding compound (DMC).

The polymeric compound may include between about 1% and about 5% glass fibres by weight.

The polymeric compound may include a non-petroleum, bio-based polymer up to about 20% weight.

The non-petroleum, bio-based polymer may include starch and/or minerals, e.g. mineral fill additives.

In another aspect, the present disclosure provides a method of making a bra cup, the method including the steps of:

forming a first padded portion having a concave side;

forming a second padded portion having a convex side;

placing the first portion into abutment with the second portion and locating a 3-dimensionally curved elongate support member between the first and second portions; and bonding the 3-dimensionally curved support member between the first and second portions.

The support member may be provided in a further portion that is arranged to be sandwiched between the first and second portions. The further portion may be a sandwich suspension layer that houses the support member. The first and second padded portions and the suspension layer may each comprise polyurethane foam and may be formed through respective moulding processes.

The method may further include a step of supporting at least the first and second portions in a cradle or die cast shapes which provide a desired curvature along a base region of the first portion and the second portion. The die cast shapes may have a three-dimensional curvature that substantially follows the curvature of the support member.

The elongate support member may be considered to provide a rib for the bra cup. The support member may be bonded to the first and second portions.

The bonding process may be considered to mould at least the first and second portions and the support member together. The bonding process may include application of heat and pressure for a certain period of time to achieve the required bond. The bonding may be assisted with glues, laminates and lining materials.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

BRIEF DESCRIPTION OF THE DRAWINGS

Embodiments of the present disclosure will now be described by way of specific example with reference to the accompanying drawings, in which.

DETAILED DESCRIPTION OF EMBODIMENTS

Figure 4A:
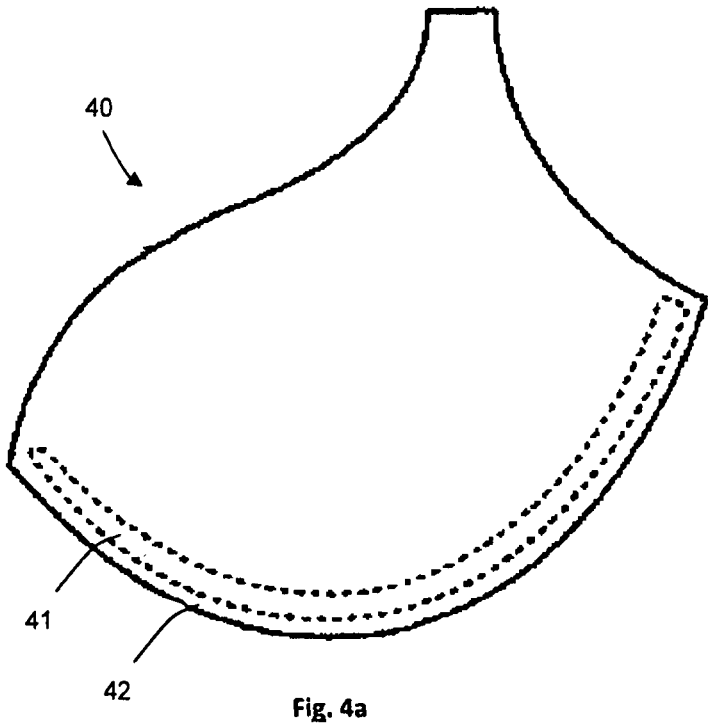
FIG. 4*a* shows a bra cup according to an embodiment of the present disclosure and FIG. 4*b* shows a bra comprising the bra cup of FIG. 4*a;*
Figure 4B:
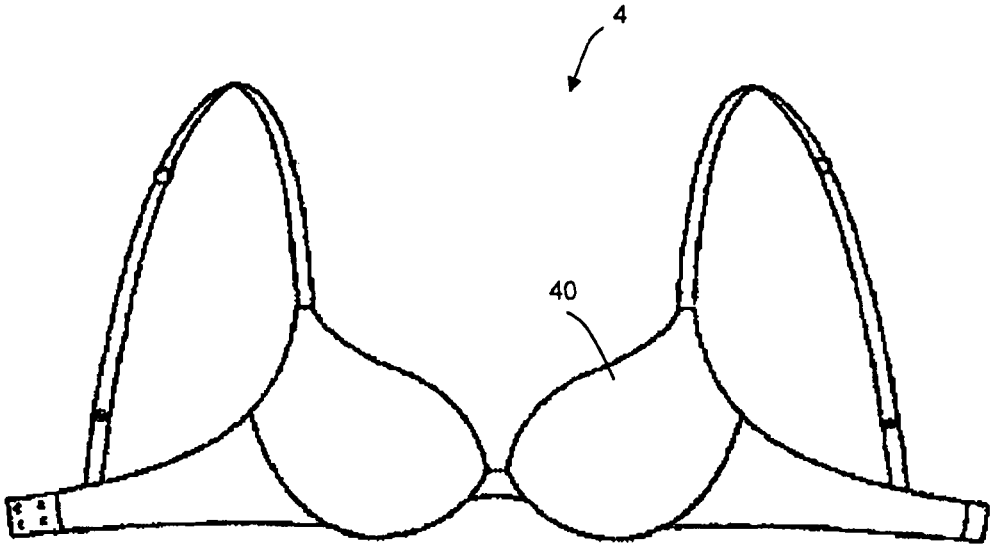

A support member, particularly a rib 2, according to an embodiment of the present disclosure is shown in FIGS. 2*a* to 2*d*. With reference also to FIGS. 4*a* and 4*b*, the rib 2 is configured to position at a region of a lower edge 42 of a bra cup 40, indicated by dotted line 41, to provide additional support to the bra cup 40, and consequently a bra 4 comprising the bra cup 4. The rib 2 can help maintain the shape of the bra cup 40 when worn, ensuring firm support for the wearer's bust. The rib 2 comprises a lateral end 21 and a medial end 22, and an elongate body portion 23 of the rib extending therebetween.

Figure 1:
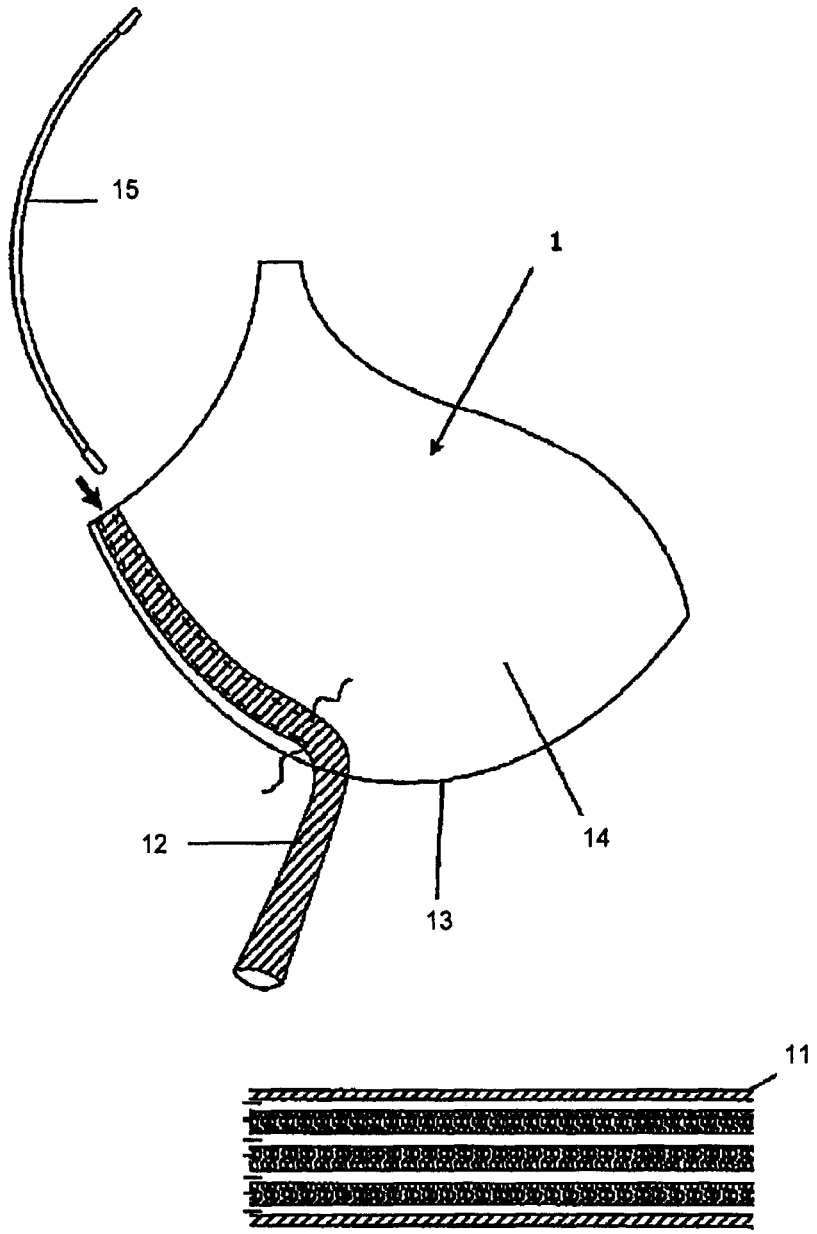
FIG. 1 shows a portion of a traditional underwire bra.
Figure 2A:
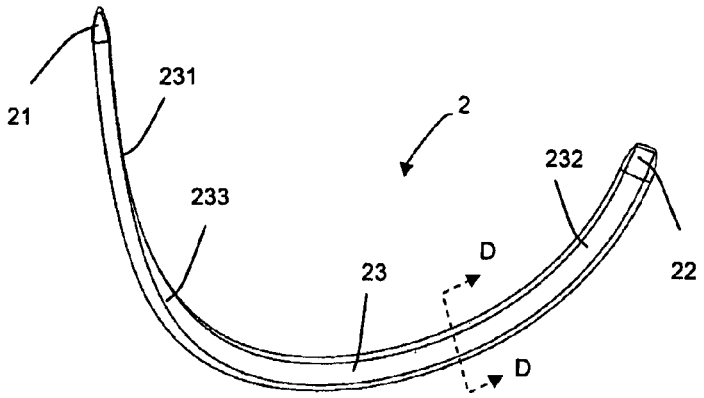
FIGS. 2*a*, 2*b* and 2*c* show a rear view, left view and a top view, respectively, of a rib for a bra cup according to an embodiment of the present disclosure
Figure 2B:
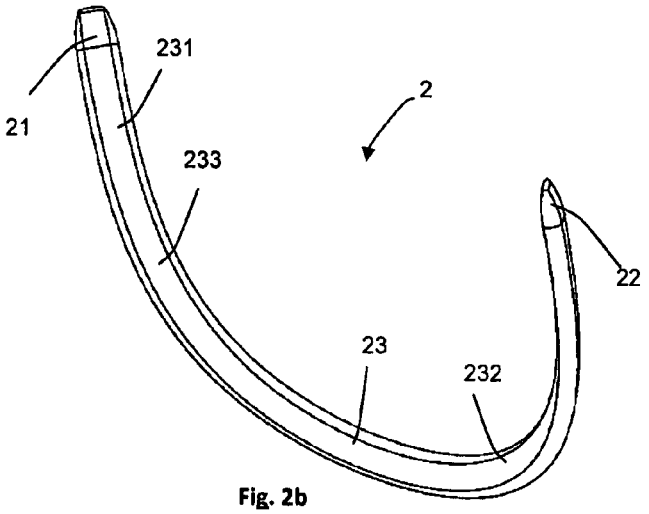
Figure 2C:
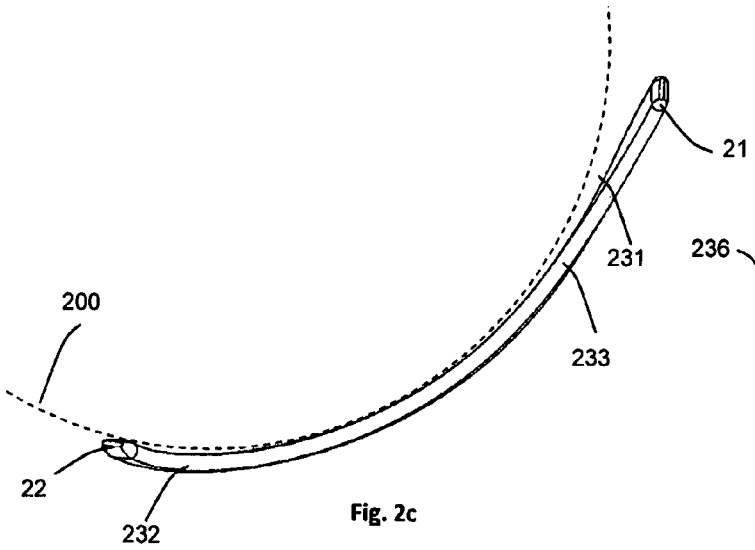
Figure 2D:
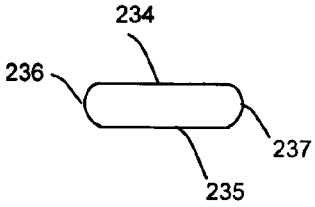
FIG. 2*d* shows a cross-sectional view of the rib along line D-D in FIG. 2*a;*
Figure 3C:
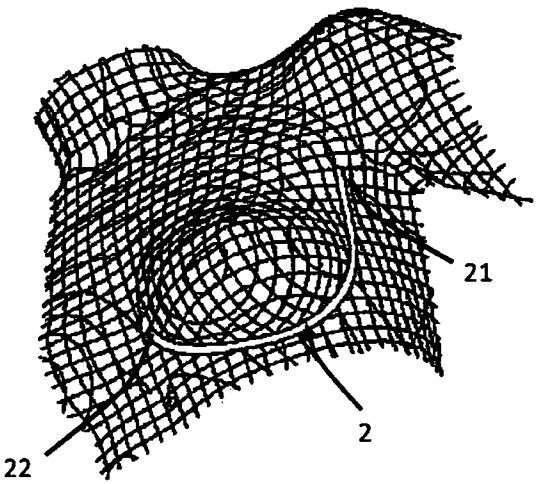
FIGS. 3*a*, 3*b* and 3*c* show a front view, side view and isometric view, respectively, of the rib of FIGS. 2*a* to 2*d* located relative to a contoured representation of a woman's body.
Figure 3B:
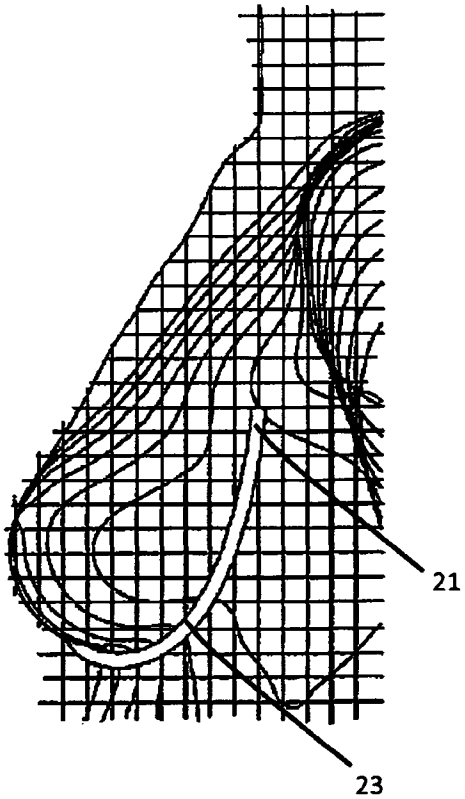
Figure 3A:
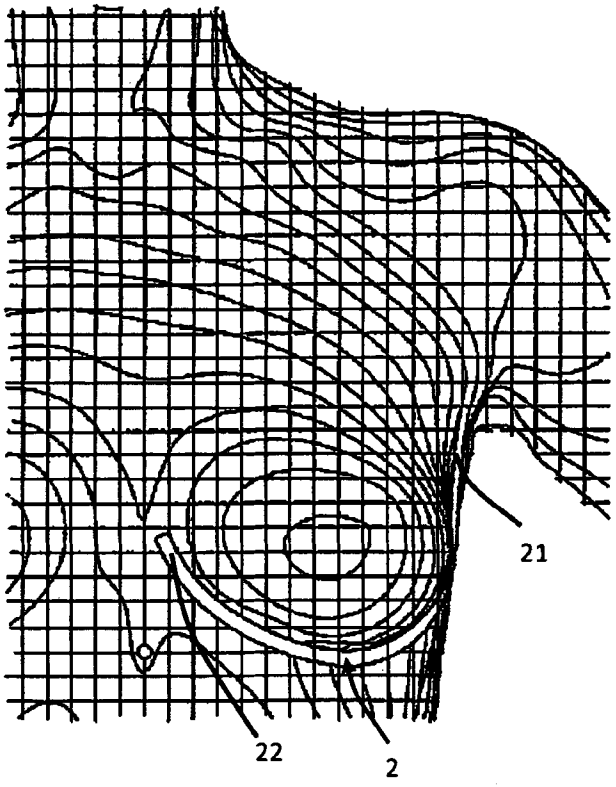

With reference to FIGS. 3*a* to 3*c*, the lateral end 21 is configured for location at a lateral side of a wearer's body, in particular at the lateral side of a wearer's chest at or adjacent the bottom of the armpit, the medial end 22 is configured for location at a medial region of the wearer's chest, at or adjacent the front of the sternum, while the elongate body portion 23 is configured to locate underneath and to the side of the wearer's breast. The rib shown in FIGS. 2*a* to 2*d* is configured for location on the left side (under the left breast) of the wearer. A corresponding rib can be configured for location on the right side of the wearer, and will effectively be a mirror image of the rib shown in FIG. 1. Accordingly, the following discussion of the left-sided rib 2 shown in FIGS. 2*a* to 2*d* applies, mutatis mutandis, to a right-sided rib according to the present disclosure.

Referring to FIG. 2*d*, the cross-sectional shape of the body 23, across a plane perpendicular to the direction of elongation of the body, as indicated by lines D-D in FIG. 2*a*, is a substantially rectangular shape with flat opposing top and bottom surfaces 234, 235 and curved opposing side surfaces 236, 237. The top surface 234 is configured to follow, and locate adjacent to, the surface of the wearer's torso, underneath and to the side of the wearer's breast. The side surfaces 236, 237 are configured to extend in a generally normal direction to the surface of the body. The top and bottom surfaces 234, 235 of the rib 2 each have a width that is greater than a width of the side surfaces 236, 237. By providing a relatively greater width to the top surface 234 in particular, the top surface 234 can extend over the surface of the wearer's body while spreading forces exerted against the body, improving comfort for the wearer. The top and bottom surfaces 234, 235 have a width in this embodiment of between about 4 mm and 8 mm, e.g. about 6 mm, and the distance between the top and bottom surfaces (the thickness of the body portion 23) is between about 2 mm and 4 mm, e.g. about 3 mm. The narrower side surfaces 236, 237 ensure that the rib 2 maintains a relatively streamlined shape against the body, while the curvature of the side surfaces 236, 237 prevents formation of sharp corners between surfaces of the rib that could cause discomfort to the wearer and/or cause damage to the bra cup 40.

At each of the lateral and medial ends 21, 22 of the rib 2, the elongate body 23 tapers to a rounded tip. This reduces the likelihood of the rib 2 causing damage to surrounding portions of the bra cup 40 or causing discomfort to the wearer when worn.

The body portion 23 is curved between the lateral and medial ends 21, 22. The arrangement is such that the body portion 23 extends along a curved path that substantially follows contours of the wearer's body, without the rib 2 needing to undergo any substantial deformation. In accordance with this, the region 41 in which the rib 2 is located also follows substantially the same curved path as the rib. Likewise, the lower edge 42 of the bra cup 40 also follows substantially the same curved path in this embodiment, with substantially the same distance being present between a bottom edge of the location region 41 of the rib 2 and the lower edge 42 of the bra cup 40.

The degree of curvature of the rib 2 is generally lower at a lateral region 231 of the body portion 23 than at a medial region 232 of the body portion 23, the lateral and medial regions 231, 232 being separated by a notional transition region indicated generally by reference line 233. The transition region 233 is located at approximately one third of the length of the body portion 23 from the lateral end 21 in this embodiment. At the transition region 233, the curvature not only changes more noticeably but the body portion 23 twists about its axis of elongation. It has been determined that the curvature and degree of twisting of the rib in this embodiment is such as to allow the rib 21 to navigate the contours of the outer surface of the wearer's chest, particularly at a region where it transitions from the posterior (front) surface of the body to a lateral (side) surface of the body, while locating the end regions of the rib at posterior and lateral surfaces that have been found to provide optimal support and comfort for the wearer. By reducing in curvature in the manner described towards the lateral end 21, it has been found that the lateral region 232 of the rib 23 can extend nearer to the armpit of the wearer, along a portion of the wearer's body that provides improved support for the bra cup and increased comfort for the wearer. The twisting also ensures that only a single face of the rib 2, particularly the top surface 234, lies next to the body.

The transition region 233 includes no sharp bend or angle. In accordance with this, the curvature of the entire body portion 23 is a spline, with smooth polynomial function that is piecewise-defined while maintaining a high degree of smoothness at the positions where the polynomial pieces connect, including at the transition region 233.

The curvature of the rib 2 in this embodiment can be considered with reference to the surface of a notional sphere. In FIG. 2*c*, the surface of a sphere is represented by the dotted line 200 and is located next to the medial region 232 of the rib 2. Across substantially the entire medial region 232, between the medial end 22 and the transition region 233, the top surface 234 of the rib 2 lies substantially flat against the surface of the notional sphere 200. However, while the medial region 232 is in this notional alignment with the surface of the notional sphere 200, the top surface 234, and indeed the lateral region 231 of the rib as a whole, diverges radially outwardly from the surface of the notional sphere starting from the transition region 233 going towards the lateral end 21. The initial divergence from the notional surface of the sphere 200 at this lateral region 231 is at an angle from the surface of the sphere 200 of about 20-30°. While the first surface at the medial region may not be perfectly spherical, given that contours of a woman's body are not spherical, the substantial relationship of the medial region 232 with the surface of the sphere in this embodiment, and the manner in which the lateral region 231 diverges therefrom, is evident.

Figure 5:
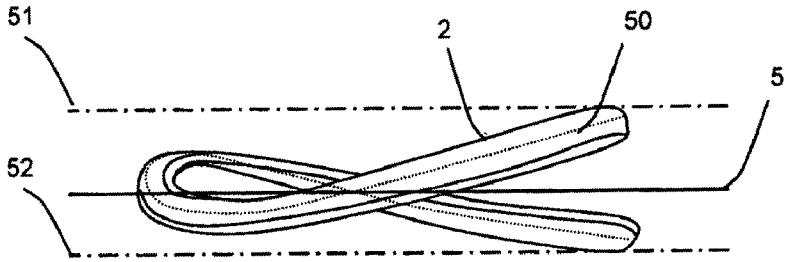
FIG. 5 shows a view of the rib of FIGS. 2*a* to 2*d* relative to a best-fit plane.

With reference to FIG. 5, due to its 3-dimensionally curved shape, the rib 2 extends substantially beyond a notional best-fit plane 5 through the curved path 50 followed by the rib 2. The rib 2 extends to positions 51, 52 that are between about 5 mm and 10 mm on either side of the best-fit plane 5.

To determine appropriate curvature, body scans may be taken and a curve generated by taking a line normal to the scanned torso and tracing a curve through the multiple intersections between the line and torso around the breast, at the region where the breast begins to protrude or change direction from the torso. The curve may be drawn in the region from the sternum around the lower breast continuing around to the underarm whilst keeping the line tangential to the initial protrusion and simultaneously normal to torso. The continuously changing intersections when joined can provide an appropriate 3d spline curve. The curves may be generated using Affine transformation.

Different sizes of curve may be arrived at by completing the procedure around larger or smaller torsos and/or breasts; however, the synergy and scalability of the shape can remain consistent The rib 2 in this embodiment is formed of a polymer, e.g. nylon, using injection moulding. The rib 2 is relatively hard. Generally, a rib in embodiments of the present disclosure may be made from one or more of polycarbonate, polyether ether ketone (PEEK), polyamide, polysulphone, nylon and a dough moulding compound (DMC) or otherwise. A dough moulding compound may include polyester resin, glass fiber, calcium carbonate, lubricants and catalysts.

A method of manufacturing a bra cup, e.g. a bra cup 40 as shown in FIG. 4*a*, comprising a rib, e.g. a rib 2 as shown in FIGS. 2*a* to 2*d*, is now described. Generally, the bra cup 40 is manufactured by enclosing the rib 2 at the lower edge 42 of the bra cup 40. The process of enclosing the rib 2 forms in effect a channel 41 about the rib 2 in this embodiment, although, in alternative embodiments, a channel may be pre-formed in the bra cup.

The bra cup 40 comprises materials that are generally softer than the material forming the rib 2. For example, the bra cup 40 may be formed of relatively soft, polyurethane materials. The hard polymer rib 2 at the lower edge 42 of the bra cup 40 can be considered to fuse with the softer, polyurethane materials in the bra cup 40 during the manufacturing process. Generally, the rib 2 may be used in conjunction with any soft polyurethane (foam) bra cup, or bra cups formed of other materials. The rib can change the rigidity and firmness of the lower section of the bra cup and this may be customized, e.g. using different rib materials, to a desired design requirement.

The rib may be considered to provide a replacement for metal underwires. The combination of e.g. the polymeric material of the rib and polyurethane (foam) bra cup material, can present an improved bra cup designed and engineered to better follow the contour and shape of the bust, as well as providing improved bust support and bust shape. The bra cup may not include wire, but rather a hard polymer at the lower edge of the bra cup. The hard polymer, lower edge of the bra cup can be considered to fuse with the softer, polyurethane materials in the bra cup. This can increase the bra cup performance in terms of support and comfort.

Figure 6:
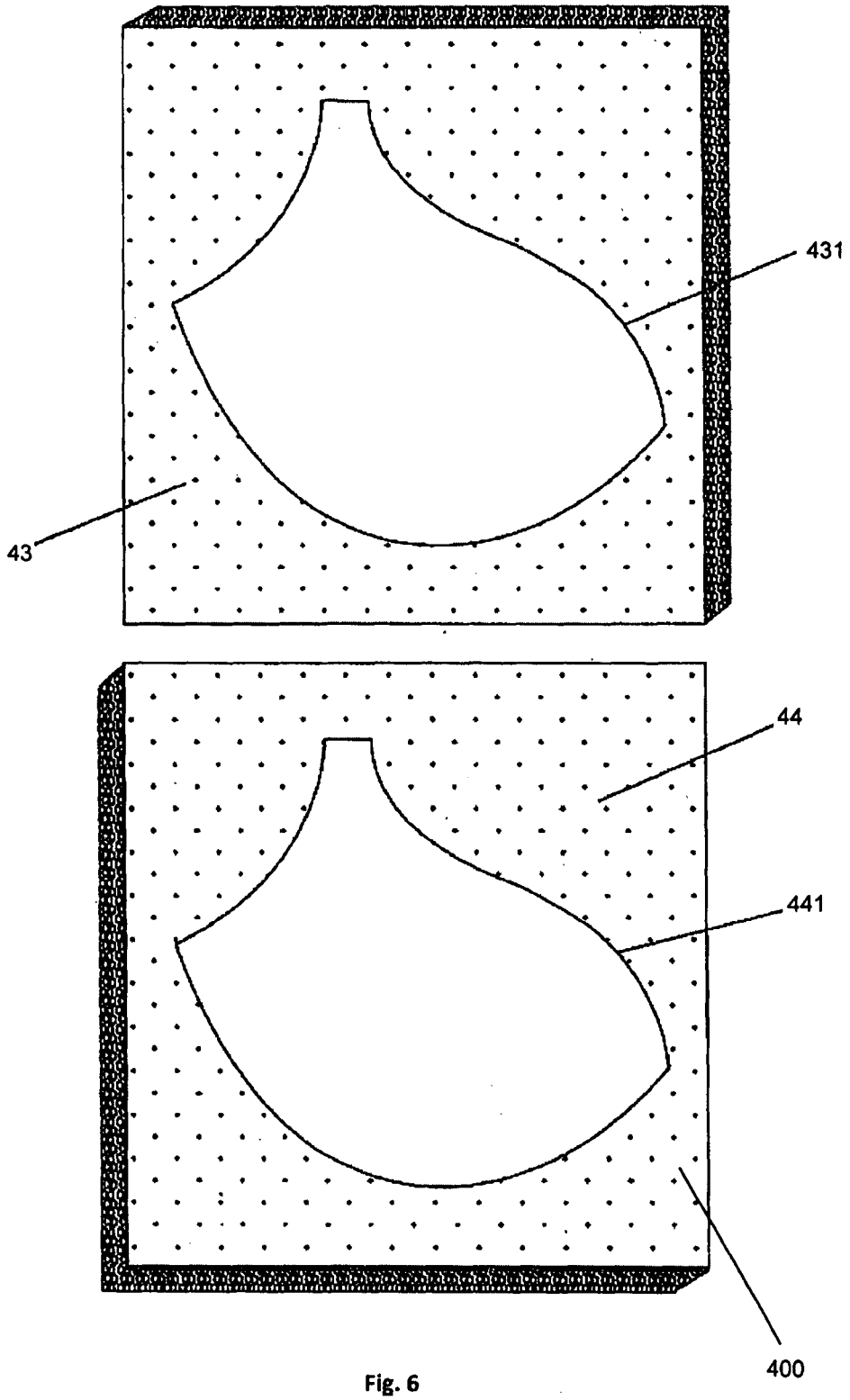
FIG. 6 depicts two foam portions used in the manufacture of the bra cup of FIG. 4*a;*

An embodiment of the manufacturing process will now be described in more detail with respect to FIGS. 6 to 8. FIG. 6 depicts the beginning of the manufacturing process with two portions or layers 43, 44 of moulded bra cups shown before they are bonded together. There first layer 43 has a concave portion 431 and the second layer 44 has a convex portion 441. The concave portion 431 and convex portion 441 are indented into generally rectangular pieces of polyurethane foam 400 that form the first and second layers 43, 44. The convex portion 441 and the concave portion 431 are subsequently bonded or fused together during a further operation while essentially untrimmed pieces of foam 400 remain connected to the concave and convex portions 431, 441.

Figure 7:
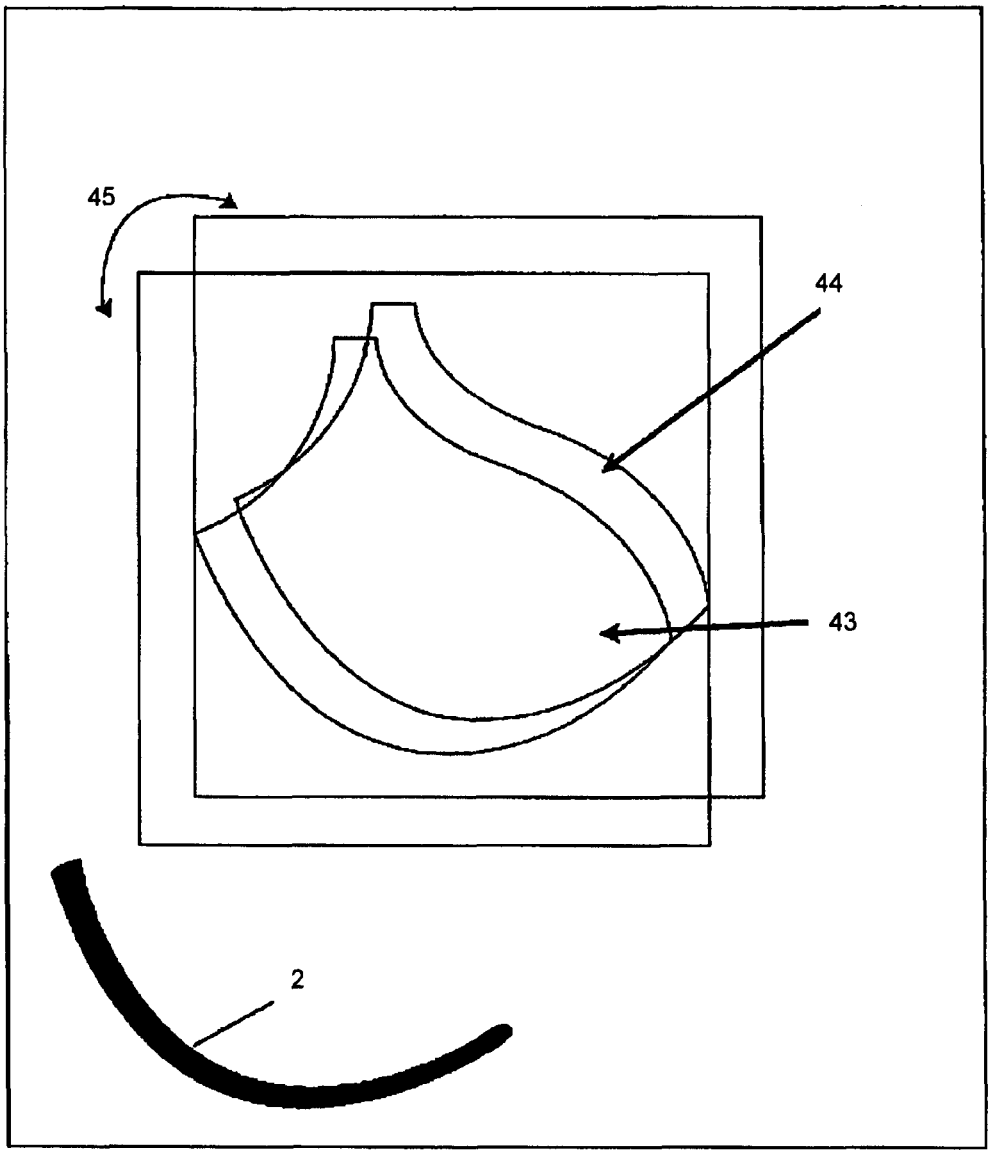
FIG. 7 shows the two foam portions of FIG. 6 coming into alignment.

FIG. 7 shows the layers 43, 44 and the convex portion 441 and the concave portion 431, being positioned together before bonding 45. The relatively hard rib 2 is injection moulded and positioned between the two polyurethane foam layers 43, 44. In alternative embodiments, the rib may be housed in a sandwich suspension layer upon positioning between the foam layers. Bonding of the two layers 43, 44 together essentially fuses or integrates the rib between lower edges of the concave and convex portions 431, 441. This may be such that the different layers and the support member are not readily separable, e.g. without causing significant damage to the bra cup. The bonding process can employ the application of heat, e.g. at greater than 100 degrees Celsius, and pressure to achieve a desired bond. The bonding can be assisted with glues, laminates and lining materials.

The process can include supporting the layers in a die cast shape which provides a desired curvature along a base region, the die cast shape having a three-dimensional curvature that substantially follows the curvature of the rib.

Figure 8:
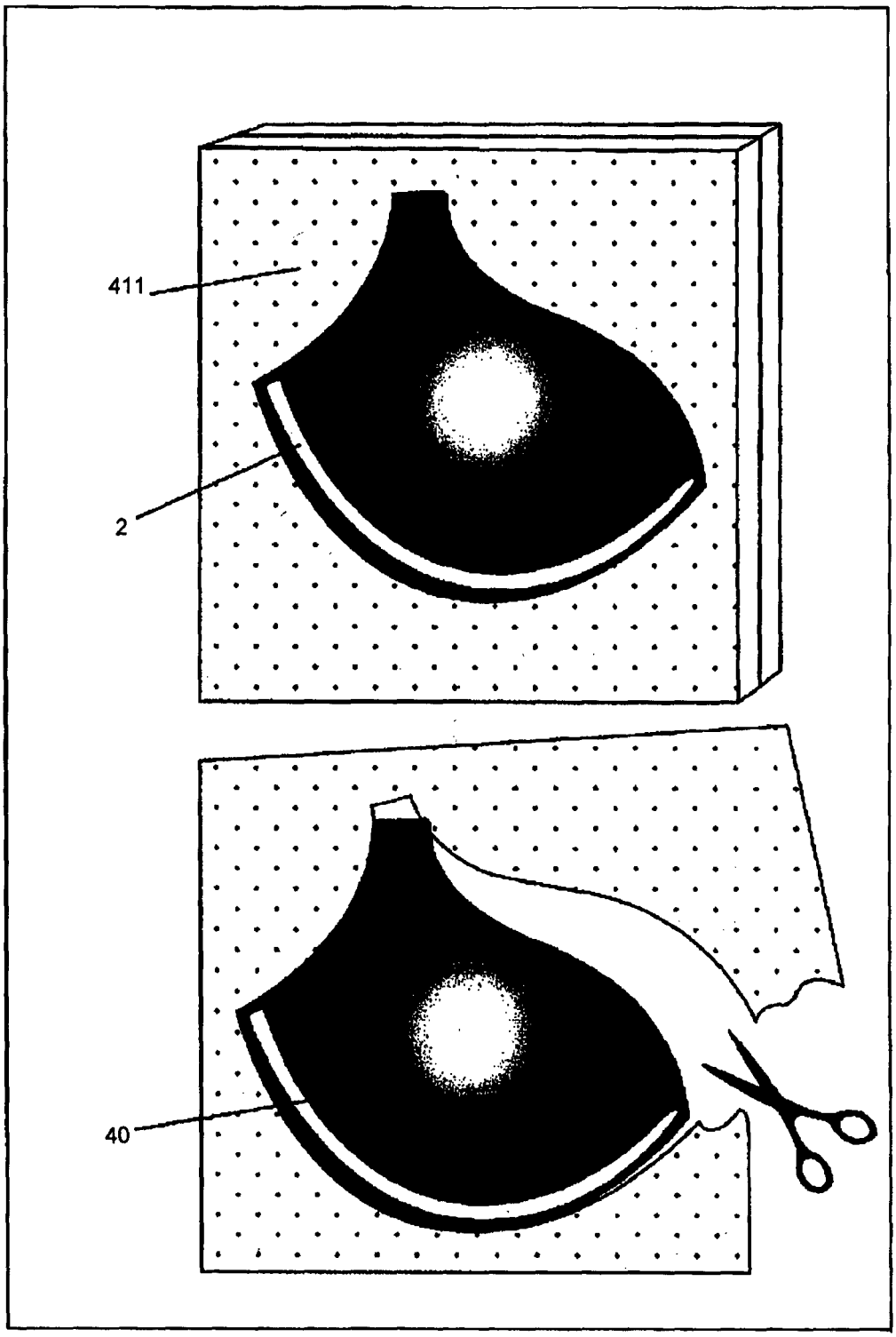
FIG. 8 shows a finishing process in the manufacture of the bra cup of FIG. 4*a.*

FIG. 8 depicts the final moulded cup 40 with the 3-dimensionally curved rib in position inside the lower cup edge. FIG. 8 also shows the trimming away of the excess foam 400 to arrive at a final shape of the bra cup 40. Trimming can be performed by the use of a hand-cutting tool, such as scissors or a blade. Alternatively, trimming may be achieved with a die-cutting machine, or other such large scale cutting device.

The bra cup 40 with the hard polymer 3-dimensionally curved rib is shown in FIG. 4*a*. The rib and cup have a desired hardness and flexibility combination, which can be varied according to the fit and function of the bra.

The completed bra 4 after final assembly as shown in FIG. 4*b* provides no visibility of the rib, as it is concealed between the portions 43, 44 of polyurethane foam in this embodiment.

Generally, in the embodiment described, the polyurethane foam cup structures of the bra cup have an additional 3-dimensionally curved hard polymeric rib that may supplant e.g. the use of metal underwires, and wherein the polyurethane foam cup structures are engineered accordingly to the shape of the rib. Nevertheless, while foam cup structures that offer a degree of padding are described, the rib may be used in combination with non-padded bra fabric, and the rib may be formed of a variety of different materials that, are suitable to form the desired shape and achieve the desired support.

The method of manufacture of the bra cup described herein may advantageously bond the rib to both a convex and a concave surface that come together to form the bra cup, such that the rib is permanently attached to the bra cup, and unlikely to work itself out of the bra during washing or use.

This approach taken herein may eliminate the use of metal underwires and may introduce a curved shaping system that integrates hard polymer compounds with soft polyurethane compounds already in use in polyurethane bra cups.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. A support member for a lower edge region of a bra cup, the support member comprising a medial end for location at or adjacent a sternum of a wearer and a lateral end for location at or adjacent a lateral side of the wearer, the support member having an elongate portion extending between the medial end and the lateral end, wherein:

the elongate portion is curved and the curvature of the elongate portion varies in three dimensions as it extends between the medial and lateral ends, and the elongate portion of the support member has a transition region intermediate the medial and lateral ends, wherein:

the curvature of the elongate portion is greater on a medial side of the transition region than on a lateral side of the transition region;

the transition region is located closer to the lateral end than the medial end at a position that is between about 25 % and 40 % along the length of the support member from the lateral end; and the elongate portion twists about its axis of elongation at the transition region.

2. The support member of claim 1, wherein the transition region is located about one third along the length of the support member from the lateral end.

3. The support member of claim 1, wherein a cross-sectional shape of the support member, in a direction perpendicular to the direction of elongation of the support member, is substantially rectangular.

4. The support member of-claim 1, wherein the elongate portion has first, second, third and fourth outer surfaces each extending between the lateral and medial ends of the support member, wherein the first and second surfaces substantially oppose each other, and the third and fourth surfaces substantially oppose each other, the third and fourth surfaces being substantially perpendicular to the first and second surfaces.

5. The support member of claim 4, wherein the first and second surfaces each have a width that is greater than a width of each of the third and fourth surfaces.

6. The support member of claim 4, wherein the first surface is configured to lie substantially parallel to contours of the surface of the wearer's body underneath and laterally of a breast.

7. The support member of claim 4, wherein the third and fourth surfaces are rounded.

8. The support member of claim 4, wherein the first and second surfaces each have a width that remains substantially the same along the length of the elongate portion.

9. The support member of claim 4, wherein the width of each of the first and second surfaces tapers at the lateral and medial ends of the support member.

10. The support member of claim 1, wherein the support member has a notional best fit plane extending through the curved path followed by the support member, and the support member extends on one or both sides of the best fit plane by greater than 5 mm.

11. The support member of claim 10, wherein the support member extends on one or both sides of the best fit plane by greater than 7 mm.

12. The support member according to claim 1, wherein the support member comprises polymeric material.

13. The support member of claim 12, wherein the polymeric material comprises one or more of the following: polycarbonate, polyether ether ketone (PEEK), polysulphone, polyamide, nylon and dough moulding compound (DMC).

14. The support member of claim 13, wherein the polymeric material includes between about 1 % and about 5 % glass fibres by weight.

15. The support member of claim 12, wherein the polymeric material includes a non-petroleum, bio-based polymer up to about 20 % weight.

16. The support member of claim 15, wherein the non-petroleum, bio-based polymer includes starch and/or minerals.

17. A bra cup comprising the support member according to claim 1 adjacent a lower edge of the bra cup.

18. The bra cup of claim 17, wherein the bra cup comprises a channel adjacent the lower edge of the bra cup for receiving the support member.

19. The bra cup of claim 18, wherein the channel comprises a medial end and a lateral end and an elongate portion extending between the medial end and the lateral end, wherein the elongate portion of the channel is curved and the curvature of the elongate portion varies in three dimensions as it extends between the medial and lateral ends of the channel.

20. The bra cup according to claim 18, wherein the curvature of the channel and/or the lower edge of the bra cup is substantially the same as the curvature of the support member.

21. The bra cup according to claim 17, wherein the bra cup comprises padding and the support member is embedded within the padding.

22. The bra cup of claim 21 comprising a first portion having a concave surface and a second portion having a convex surface, the concave surface and the convex surface being at least partially located in abutment and secured together about the support member.

23. The bra cup of claim 22, wherein the support member is bonded to one or both of the first and second portions.

24. A bra cup comprising:

a first portion made of polyurethane foam and having a concave side;

a second portion made of polyurethane foam and having a convex side, the concave side and convex side being located in abutment and secured together;

a support member according to claim 1;

wherein lower edges of the concave side and convex side substantially follow the curvature of the support member; and wherein the support member has a stiffness that is greater than a stiffness of the polyurethane foam.

25. A method of making a bra cup, the method including the steps of:

forming a first padded portion having a concave side;

forming a second padded portion having a convex side;

placing the first portion into abutment with the second portion and locating a support member according to claim 1 between the first and second portions; and bonding the support member between the first and second portions.

* * * * *